US010142724B2

(12) United States Patent
Tsuge

(10) Patent No.: US 10,142,724 B2
(45) Date of Patent: Nov. 27, 2018

(54) SOUND OUTPUT DEVICES

(71) Applicant: MAKITA CORPORATION, Anjo-shi, Aichi (JP)

(72) Inventor: Kazunori Tsuge, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 8 days.

(21) Appl. No.: 15/246,039

(22) Filed: Aug. 24, 2016

(65) Prior Publication Data

US 2017/0111732 A1 Apr. 20, 2017

(30) Foreign Application Priority Data

Oct. 19, 2015 (JP) ..... 2015-205815

(51) Int. Cl.

| | |
|---|---|
| ***H04R 1/02*** | (2006.01) |
| ***H04R 1/28*** | (2006.01) |
| ***H04R 5/02*** | (2006.01) |
| ***H04R 3/12*** | (2006.01) |

(52) U.S. Cl.

CPC ..... *H04R 1/2819* (2013.01); *H04R 1/023* (2013.01); *H04R 1/2811* (2013.01); *H04R 3/12* (2013.01); *H04R 5/02* (2013.01); *H04R 2201/028* (2013.01); *H04R 2201/029* (2013.01)

(58) Field of Classification Search

CPC ..... H04R 1/023; H04R 1/028; H04R 1/2807; H04R 1/2819; H04R 1/2834; H04R 1/2849; H04R 2201/02; H04R 2201/025; H04R 2201/028; H04R 2205/022; H04R 2205/026; H04R 5/02; H04R 1/2811; H04R 2201/029

USPC ... 381/300, 301, 304, 305, 87, 89, 332, 333, 381/334, 335, 345, 349, 182, 186, 386, 381/387, 388; 181/144, 145, 146, 147, 181/155, 156, 199; 348/838

See application file for complete search history.

(56) References Cited

U.S. PATENT DOCUMENTS

| | | | | |
|---|---|---|---|---|
| 4,755,881 | A * | 7/1988 | Bartlett | H04N 9/3141 312/114 |
| 5,781,853 | A * | 7/1998 | Johnson | A45C 15/00 381/386 |
| 6,968,067 | B2 * | 11/2005 | Lopez | H04R 5/02 381/182 |
| 2008/0025544 | A1 * | 1/2008 | Maldonado | H04R 1/028 381/334 |
| 2013/0006405 | A1 | 1/2013 | Tsuge et al. | |
| 2015/0036858 | A1 * | 2/2015 | Aboabdo | H04R 1/02 381/334 |

FOREIGN PATENT DOCUMENTS

JP 2013-012984 A 1/2013

* cited by examiner

*Primary Examiner* — Huyen D Le
(74) *Attorney, Agent, or Firm* — Oliff PLC

(57) ABSTRACT

A sound output device has a sound output unit outputting sound to an exterior, a battery attachment unit to which an electric tool battery is attached, and a case supporting the sound output unit and the battery attachment unit. The case includes a first inner wall structure defining a first inner space accommodating the sound output unit, and a second inner wall structure defining a second inner space different from the first inner space. The second inner wall structure is configured to resonate the sound output of the sound output unit.

24 Claims, 11 Drawing Sheets

SOUND OUTPUT DEVICES

CROSS-REFERENCE TO RELATED APPLICATIONS

This application claims priority to Japanese patent application serial number 2015-205815 filed Oct. 19, 2015, the contents of which are incorporated herein by reference in their entirety for all purposes.

BACKGROUND

Embodiments of the present invention relate to sound output devices that are capable of outputting sound by using an electric tool battery as a power source.

At construction sites where interior outfitting of houses or the like is performed, nowadays more and more battery type sound output devices such as radio sets with speakers are used for enjoying music, where said devices typically employ electric tool batteries as the power source (See e.g., publication JP2013-12984A). The electric tool batteries are rechargeable batteries not only used in the sound output devices but also as the power source for the electric tools utilized for the interior outfitting work. Some of these battery type sound output devices may also be compatible and capable of use with portable electric apparatuses such as smart phones, tablets, portable music players, and portable game machines.

The speakers described above are used at interior outfitting construction sites, where dust is likely to fume up. Thus, in order to mitigate the harmful impact of the dust, the speakers adopt a hermetic case structure, to enhance the dustproof/waterproof effect. Through the use of the hermetic case structure, however, while it is possible to enhance the dustproof/waterproof effect, one of the drawbacks is that low-sound frequencies of the output sound frequencies may be excluded. Consequently, as a result, the listener often complains of a rather poor tone quality.

There is thus a need for a battery type sound output device which is capable of both a high dustproof/waterproof effect and outputting a sound of high tone quality, without excluding low-sound frequencies.

SUMMARY

In accordance with an aspect of the present invention, certain embodiments of the present invention include a sound output device. The sound output device may have a sound output unit outputting sound to an exterior, a battery attachment unit to which an electric tool battery is attached, and a case supporting the sound output unit and the battery attachment unit. The case may include a first inner wall structure defining a first inner space accommodating the sound output unit, and a second inner wall structure defining a second inner space different from the first inner space. The second inner wall structure is configured to resonate the sound output of the sound output unit.

Thus, the sound output from the sound output unit, in the first inner space, may resonate (e.g., Helmholtz resonance) in the second inner space, and the lower register and longer wavelength portion of the output sound may be amplified to enhance the sound effect. In enhancing the sound effect, resonance is caused in the second inner space, which is different from the first inner space accommodating the sound output unit. Thus, even when the second inner space communicates with the exterior for resonance and has an opening where dust and water may intrude from the exterior, it acts as a buffer where the dust and water do not directly enter the first inner space via the opening. Accordingly, the sound output device is of high dustproof/waterproof effect and is able to produce a high tone quality sound output.

According to another aspect, the first inner wall structure and the second inner wall structure may be provided in the case such that the first inner space is above and adjacent to the second inner space. Thus, even when the second inner space is a space communicating with the exterior and allows intrusion of dust and water from the exterior, the gravitational effect may suppress intrusion of the dust and water into the first inner space from the second inner space. Thus, the dustproof/waterproof effect may be further enhanced.

According to another aspect, the first inner space and the second inner space may be divided from each other by a partition. The partition has an elastic partition formed so as to be capable of vibration upon receiving the sound output of the sound output unit. Thus, the sound output in the first inner space is easily resonated by vibration of the elastic partition in the second inner space, for example, in a way of Helmholtz resonance. As a result, the lower register and longer wavelength portion of the output sound may be amplified and the sound effect may be efficiently enhanced.

According to another aspect, the case may include a third inner wall structure defining a third inner space containing the battery attachment unit. The third inner wall structure has an opening configured to cause the third inner space to communicate with the exterior, and an opening/closing cover configured to close the opening so as to allow opening and closing. A hermetic seal structure is provided between an edge of the opening and an edge of the opening/closing cover, and is configure to bring the edges into close contact with each other when the opening/closing cover is closed.

Thus, when the opening/closing cover is closed, the third inner space is hermetically closed, so that the third inner space may maintain a dustproof/waterproof quality. The third inner space contains a battery attachment unit to which a rechargeable electric tool battery is detachably attached. Thus, the battery attachment unit and the electric tool battery attached to the battery attachment unit may be protected from dust and water. As a result, failure of the battery type sound output device and of the rechargeable electric tool battery due to intrusion of such dust/water may be prevented.

According to another aspect, the second inner space may be configured to be capable of containing a gadget, for example a small article and/or little item. Alternatively, the second inner wall structure may have an opening allowing accommodation of such a gadget. Further examples of the gadget may include portable electric apparatuses such as a smart phone, a tablet, a portable music player, and a portable game machine. Through the second inner space configuration, these types of gadgets may be conveniently stored within the battery type sound output device.

According to another aspect, the second inner wall structure may have a door configured to open and close the second inner space with respect to the exterior. Thus, the door may enhance the dustproof/waterproof property with respect to the second inner space. Additionally, the door may prevent dropping of the accommodated gadget in the second inner space. The door may also have an opening configured to communicate between the second inner space and the exterior. The opening may enhance effect of Helmholtz resonance in the second inner space. As a result, the Helmholtz resonance within the second inner space may improve a sound of tone quality.

According to another aspect, the battery type sound output device may have a locking device configured to lock the door in a selectively releasable manner. Thus, the gadget stored in the second inner space may be prevented from being stolen by locking the door.

According to another aspect, the case, e.g., the door, may be provided with a cord lead-out portion configured to allow a cord to be led to the exterior from within the second inner space. Thus, an electric cord connected, for example, to an external power source may be lead into the interior of the second inner space. As a result, the portable electric apparatus stored in the second inner space may be recharged.

According to another aspect, the case is provided with an operation input unit configured to allow an operation of a gadget such as a portable electric apparatus via radio communication. Thus, the operation input unit may operate the gadget stored within the second inner space. As a result, the gadget may be operated while being stored within the second inner space.

DETAILED DESCRIPTION

Figure 10:
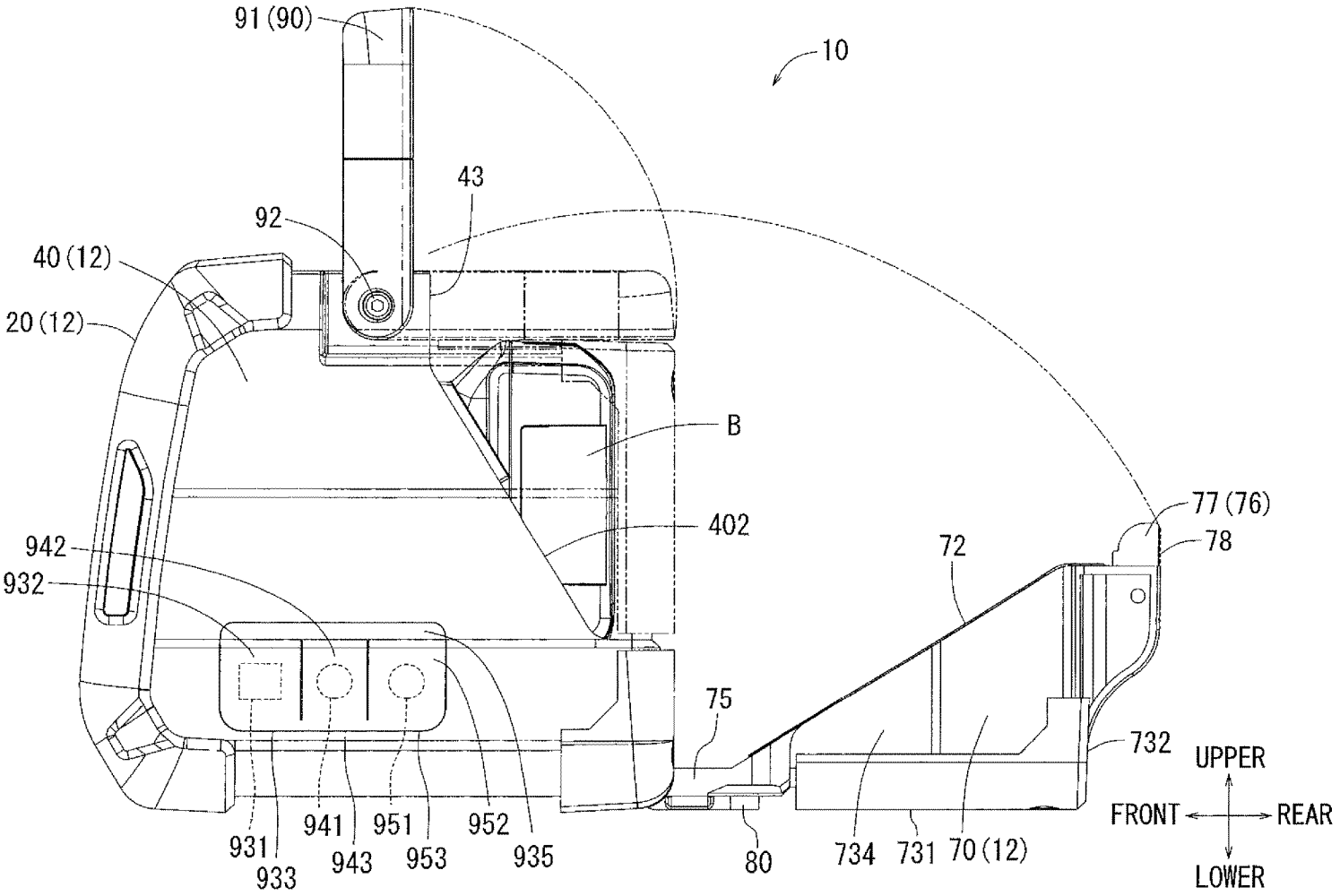
FIG. 10 is a left side view of the speaker while an opening/closing cover is opened and a handle is raised.
Figure 11:
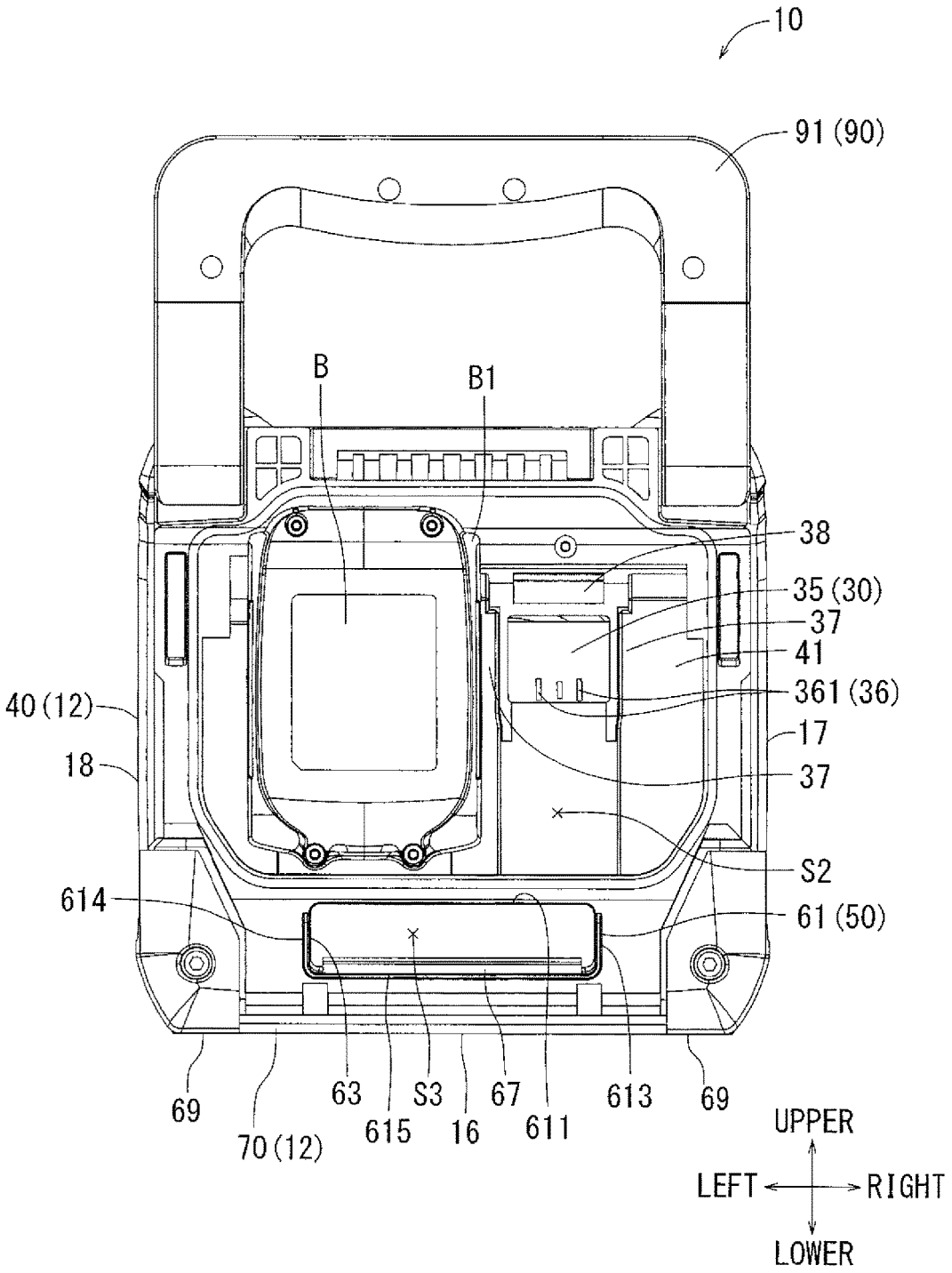
FIG. 11 is a rear view of the speaker of FIG. 10.

In the following portion of the disclosure, a sound output device according to an embodiment of the present invention will be described with reference to FIGS. 1 through 11. In describing a speaker 10, directions such as "front, rear, upper, lower, right, and left" indicated in the drawings will be referred to. The front direction is defined based on the sound output direction of the speaker 10, and the upper direction is defined based on the direction in which a handle 90 is raised (where the raised configuration is shown in FIGS. 10 and 11).

Figure 6:
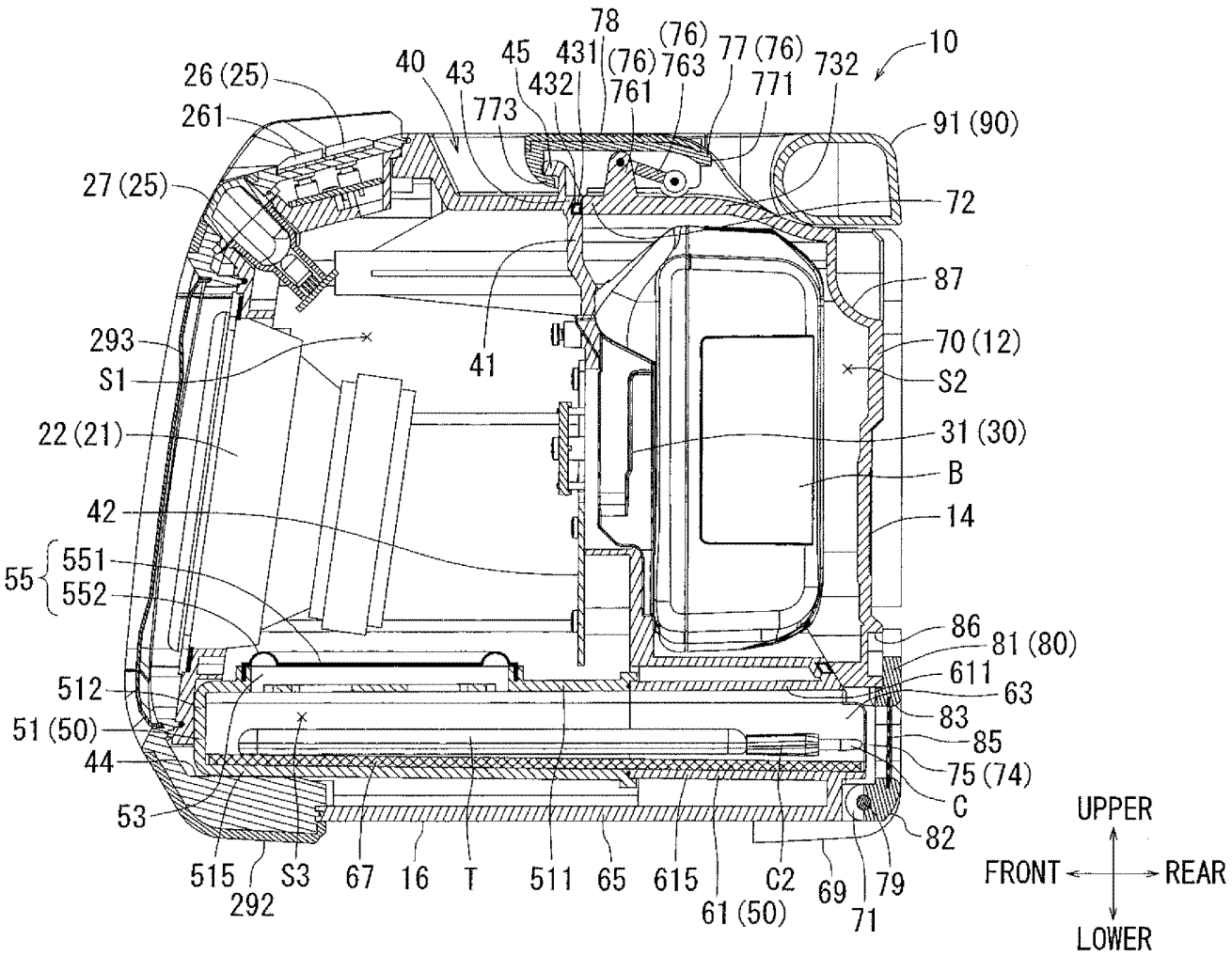
FIG. 6 is a cross-sectional view taken along line VI-VI in FIG. 1.
Figure 7:
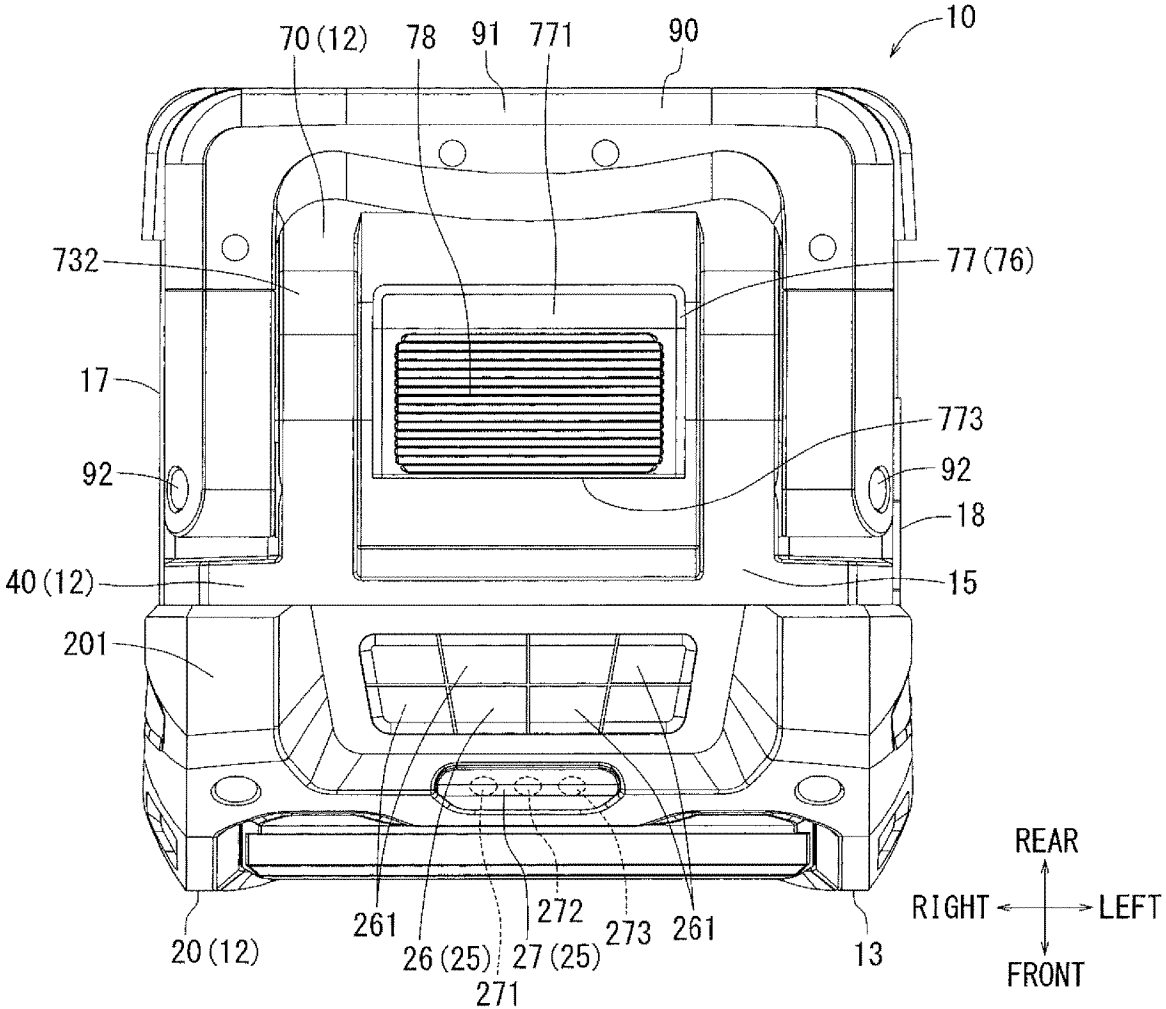
FIG. 7 is a plan view of the speaker.

The speaker 10 is an example of the battery type sound output device. As shown in FIG. 6, the speaker 10 is a speaker which outputs sound by using an electric tool battery B as the power source. The speaker 10 also comprises a case 12 substantially constituting an exterior covering. This case 12 also serves as a first inner wall structure and a third inner wall structure as described below.

Figure 1:
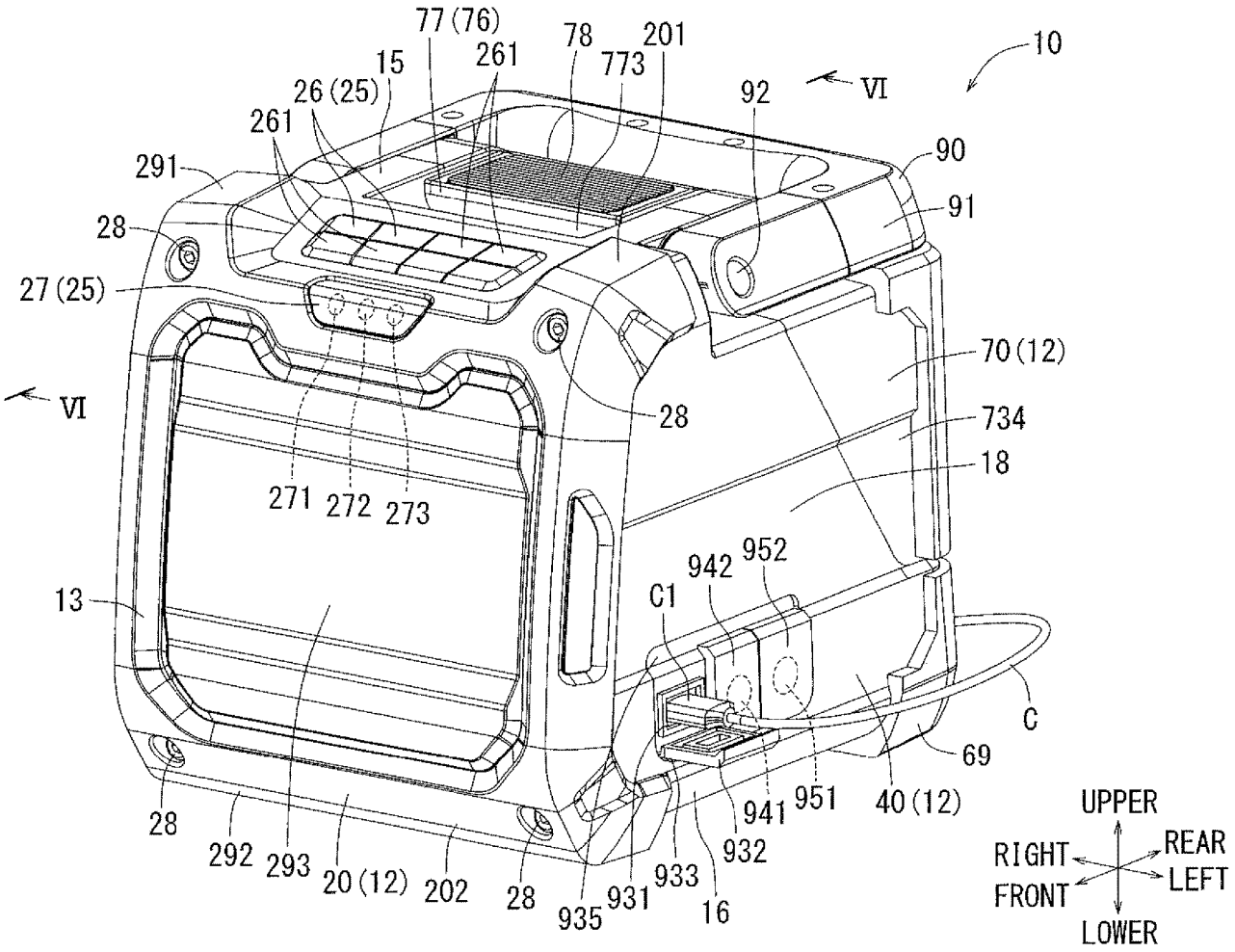
FIG. 1 is a perspective view of a speaker as seeing from front.
Figure 2:
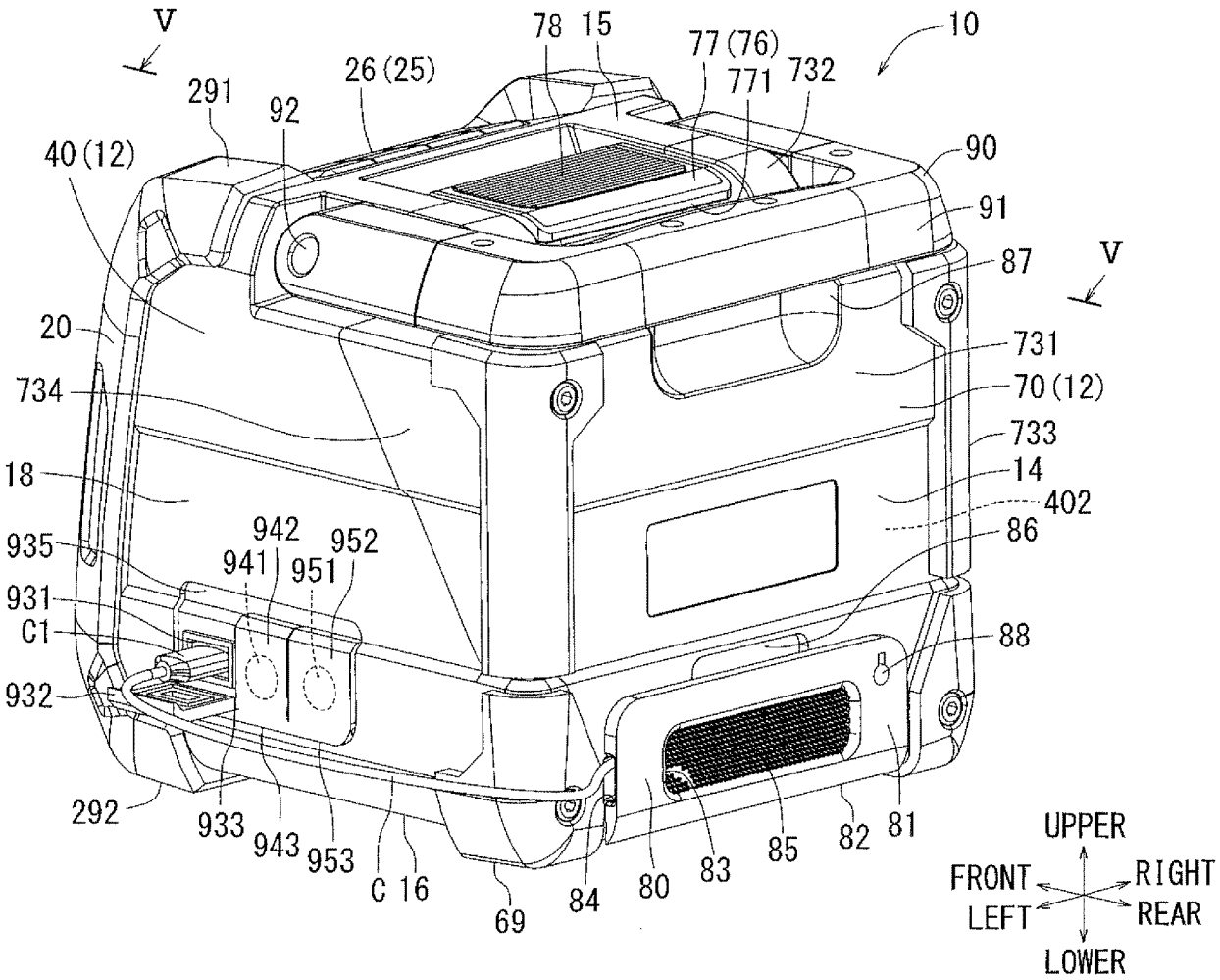
FIG. 2 is a perspective view of the speaker as seeing from back.

As shown in FIGS. 1 and 2, the case 12 is of a substantially cubic configuration. The speaker 10 has a front surface 13, a rear surface 14, an upper surface 15, a lower surface 16, a right surface 17, and a left surface 18. The case 12 further comprises a case main body 40, a front surface frame 20, and an opening/closing cover 70. That is, the case 12 is structurally composed by arranging three exterior members in the front/rear direction and assembling the members together.

As shown in FIGS. 1 and 2, the case main body 40 forms the upper surface 15, the lower surface 16, the right surface 17, and the left surface 18. That is, the case main body 40 is open and the speaker is exposed on the front and rear sides. Case 12 comprises a front surface frame 20, defining a part of the front surface 13, mounted to a front surface opening 401 (shown in FIG. 4) of the case main body 40 by screws. The front surface frame 20 portion of case 12 in effect seals the periphery of the front surface opening 401 of the case main body 40 portion of case 12. Case 12 also comprises opening/closing cover 70 defining a part of the rear surface 14, mounted to a rear surface opening 402 of the case main body 40 (as shown in FIG. 10), where the opening/closing cover 70 closes the rear surface opening 402.

Figure 3:
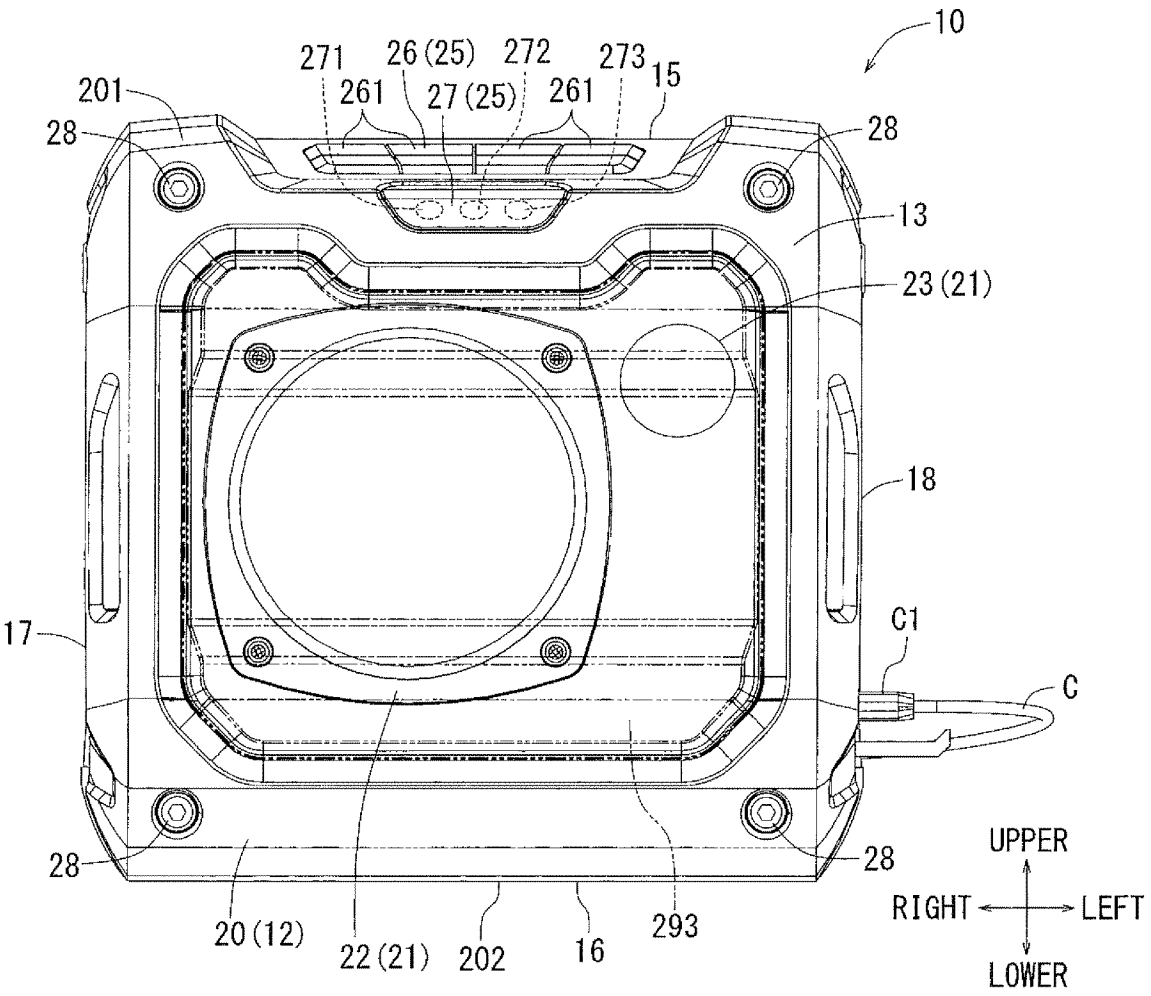
FIG. 3 is a front view of the speaker.

As shown in FIGS. 1 and 3, the front surface frame 20 extends along and surrounds the upper, lower, left, and right edges of the case main body 40, along their respective peripheries. An upper portion 201 of the front surface frame 20 protrudes to the uppermost portion of the case 12 when the handle is lowered. A lower portion 202 of the front surface frame 20 protrudes to the lowermost portion of the case 12. The exterior surfaces of the upper portion 201 and the lower portion 202 of the front surface frame 20 are covered with elastomer portions 291 and 292. A sound output unit 21 is mounted in the interior of the central portion of the front surface frame 20. The sound output unit 21 outputs sound to the exterior. A net 293 is stretched over the central portion of the front surface frame 20 and easily allows for transmission of sound. The sound output unit 21 and an operation panel device 25 are mounted within recesses of the front surface frame 20. The four corners of the front surface frame 20 are fastened to the case main body 40 by screws 28.

Figure 5:
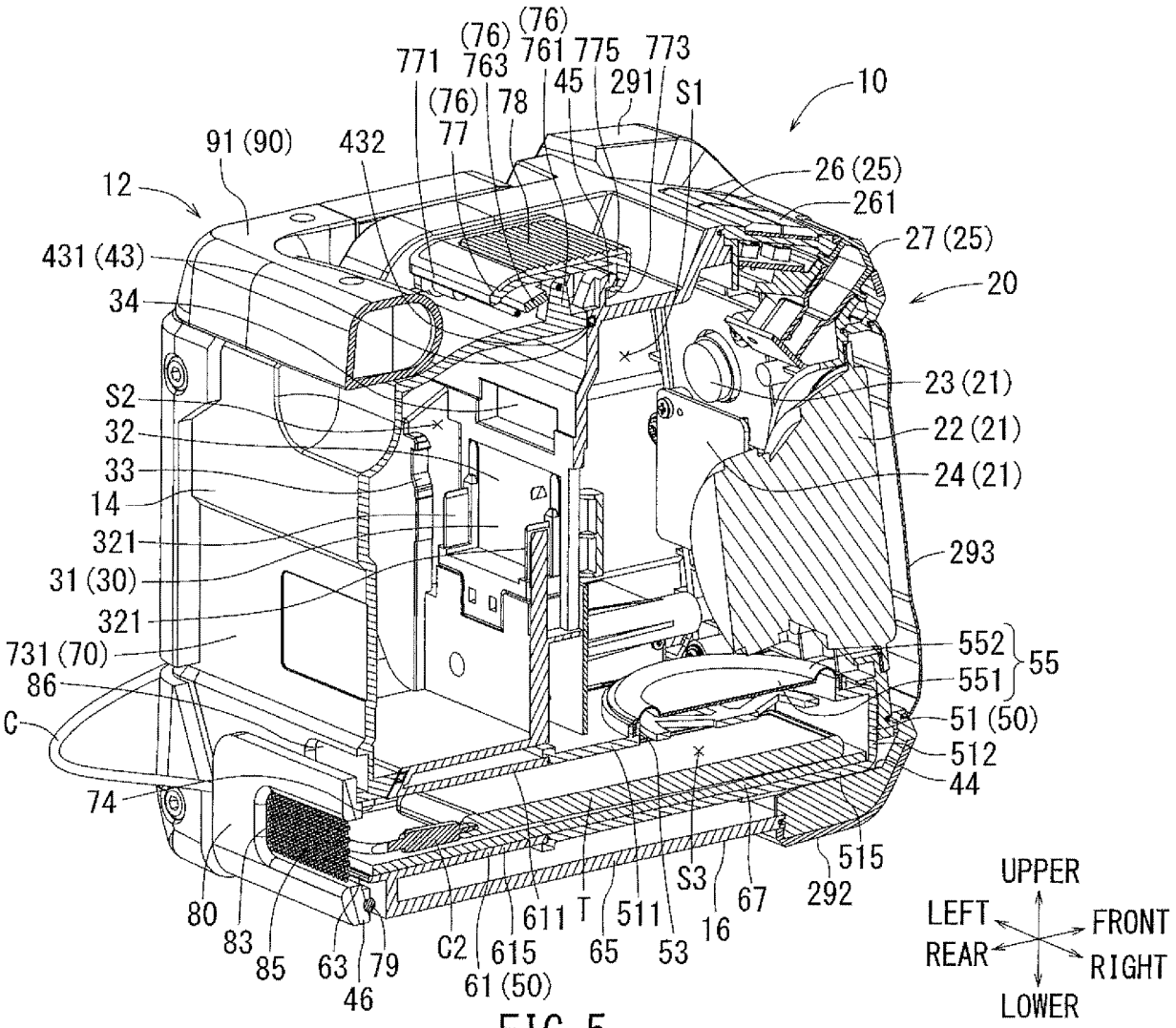
FIG. 5 is a cross-sectional view taken along line V-V in FIG. 2.

As shown in FIG. 5, the sound output unit 21 comprises a speaker main body 22, a tweeter speaker portion 23, and a sub control portion comprising a circuit board 24. The speaker main body 22 is integrally mounted to the front surface frame 20. This speaker main body 22 contains a magnet, a voice coil, etc. for sound output, and outputs sound forwards through the net 293. The tweeter speaker portion 23 mainly outputs sound of the high-tone range. In contrast to the tweeter speaker portion 23, the speaker main body 22 mainly outputs sound of the mid-tone range. The sub control portion 24 is configured to control the output of the speaker main body 22 and of the tweeter speaker portion 23. More specifically, the sub control portion 24 can perform various control operations related to the sound output of the speaker main body 22 and of the tweeter speaker portion 23.

As shown in FIG. 3, the operation panel device 25 is mounted to the upper portion of the front surface frame 20. The operation panel device 25 is located above the sound output unit 21. The operation panel device 25 has an operation panel portion 26 and a display portion 27. The operation panel portion 26 may include eight operation buttons 261 in an array, comprising several rows of buttons arranged side by side. Each operation button 261, in turn, may transmit an operation input signal to a main control unit 42, which comprises a circuit board, by being depressed as described below. Non-limiting examples of the operation functions of the eight operation buttons 261 include an on/off operation for pairing with an apparatus via Bluetooth (registered trademark), an operation for resuming and stopping of the paired apparatus, and the operation of adjusting the output volume. The operation panel portion 26, with the structure of array of buttons as described above, is an example of the operation input unit. The operation panel portion 26 makes it possible to operate a portable electric apparatus T (See FIG. 8) via a main control unit 42, where said control unit may comprise a circuit board as described above (See FIG. 4). Examples of the portable electric apparatus T include all portable electric apparatuses capable of playing music files such as a smart phone, a tablet, a portable music player, and a portable game machine.

As shown in FIG. 3, the display portion 27 is mounted to the front surface frame 20 and positioned below the operation panel portion 26. The display portion 27 contains three kinds of light emitting diodes (LEDs) emitting three colors of green, red, and blue. More specifically, the display portion 27 has a green LED 271 arranged on the left side, a red LED 272 arranged in the center, and a blue LED 273 arranged on the right side. The main control unit 42 is connected to the LEDs 271, 272, and 273 and controls each of the LEDs 271, 272, and 273 to turn on and light up or blink. More specifically, when the green LED 271 on the left side is turned on or lit up, this indicates that an input apparatus is connected to an external input terminal (second connector portion 941) constituting an AUX or auxiliary terminal, allowing sound input. When the blue LED 273 on the right side is turned on or lit up, this indicates the Bluetooth (registered trademark) device pairing process has been completed to allow sound input from an external apparatus. When the blue LED 273 on the right blinks every other second, this indicates that the Bluetooth (registered trademark) pairing process is currently being undertaken by the control unit 42 and is ongoing. When the blue LED 273 on the right side blinks every two seconds, this indicates that the Bluetooth (registered trademark) pairing process by is on standby.

When the red LED 272 (as shown in FIG. 3 at the center of panel 27) is continuously blinking, this indicates that the residual battery capacitance of the electric tool battery B (See FIG. 6) attached to a battery attachment unit 30 is 5 percent or less. The red LED 272 at the center also blinks in reaction to the operation of each of the operation buttons 261. For example, when the output volume is increased or decreased by pressing the operation buttons 261, the red LED 272 at the center blinks at that time when the button is pressed. When the volume buttons are being pressed and output volume has reached maximum or minimum, where further volume adjustment operation is impossible, the red LED 272 at the center is turned on or lit up. This indication that the output volume has reached maximum or minimum may be extinguished upon the detection of a signal indicating the operation button increasing or decreasing volume is not being depressed any longer and has been let go of, in an off state; or it may be extinguished after the elapse of a fixed period of time after the detection of such a signal. Alternatively or in addition to the above construction, the display portion 27 may be formed so as to be capable of displaying numbers, characters, etc. For example, numbers and characters depending on reproduction information on a music file or the like reproduced by the portable electric apparatus T (See FIG. 8) may be displayed.

As shown in FIG. 6, the case main body 40 is provided with an inner partition 41 dividing the interior of the case 12 into front and rear areas. At a substantially intermediate position in the front-rear direction of the interior of the case 12, the inner partition 41 expands in an up-down/right-left plane to divide the interior of the case 12 into front and rear areas. A front space S1 is defined in front of the inner partition 41 for accommodating the sound output unit 21. A first inner space includes the front space S1 and a rear space S2 described below. The main control unit 42 is provided on the front surface of the inner partition 41. The main control unit 42, comprising a circuit board as described above, further has an onboard radio communication module. In an exemplary mode of operation, the main control unit 42 operates the portable electric apparatus T based on operational input from the operation panel portion 26. The main control unit 42 receives from the portable electric apparatus T sound output data for effecting sound output by the sound output unit 21. The radio communication module can engage in short-distance radio communication that matches the standards for short-distance radio communication of generally low power consumption, such as "Bluetooth (registered trademark)" or "ZigBee (registered trademark)."

As shown in FIGS. 6 and 11, the battery attachment unit 30 is provided at the rear surface of the inner partition 41. The battery attachment unit 30 is formed so as to allow attachment of two kinds of electric tool batteries B. The battery attachment unit 30 includes a first battery attachment unit 31 on the left side and a second battery attachment unit 35 on the right side. The rear space S2 accommodating the battery attachment unit 30 is defined at the rear side of the inner partition 41. A third inner space includes the rear space S2 and the front space S1.

As shown in FIGS. 6 and 11, the first battery attachment unit 31 is configured to allow slide attachment of a relatively large electric tool battery B (of an output voltage of such as 18 V or 14.4 V). In contrast, the second battery attachment unit 35 is configured to allow slide attachment of a relatively smaller electric tool battery (battery not shown; of an output voltage of such as 10.8 V). The relatively large electric tool battery B contains a large number of cells, and the relatively smaller electric tool battery contains substantially fewer cells. While the batteries attached to and detached from the first battery attachment unit 31 and the second battery attachment unit 35 differ in size, both batteries are slide-attached to either the battery attachment unit 31 or 35. The voltage supplied from the relatively large electric tool battery B attached to the first battery attachment unit 31 is reduced in magnitude. The voltage supplied from the relatively small electric tool battery attached to the second battery attachment unit 35 is increased in magnitude. As a result, the voltage supplied from the electric tool battery is adjusted to a predetermined voltage (12 V), and is utilized for the sound output of the sound output device 21.

As shown in FIGS. 5 and 11, the first battery attachment unit 31 and the second battery attachment unit 35 respectively have structural components comprising terminals 32 and 36, slide guide portions 33 and 37, and female hooks 34 and 38 formed by recesses. The terminals 32 and 36 have terminals 321 and 361 that can be connected to the terminal of the electric tool battery B which is slid in. The slide guide portions 33 and 37 are fit-engaged in the sliding direction with the slide guide portion of the electric tool battery B. A male hook of the electric tool battery B formed by a protrusion is fit-engaged with the female hooks 34 and 38 when the slide attachment of the electric tool battery B is completed.

Only one electric tool battery B may be attached to the first battery attachment unit 31 and the second battery attachment unit 35 at a time. For example, when an attempt is made to attach the electric tool battery corresponding to battery attachment unit 35 (not shown), with one electric tool battery (e.g., the one indicated by symbol B of FIG. 11) attached, a case corner portion (e.g., the one indicated by numeral B1 of FIG. 11) of one electric tool battery (e.g., the one indicated by symbol B of FIG. 11) hits a case corner portion of the electric tool battery (not shown) upon attempting to slide it in. Thus, it is impossible to simultaneously attach both electric tool batteries. The electric tool battery B is attached to the first battery attachment unit 31 by sliding downwards from above. The electric battery may be discharged through use as the power source of the speaker 10. The electric tool battery B is detached from the battery attachment unit 31 by releasing the male hook from the female hook 34 and sliding upwards from below. The discharged electric battery may be recharged through using a dedicated charger. The electric battery corresponding to battery attachment unit 35 (not shown) may be detached and released in analogous fashion, by releasing the male hook from female hook 38.

The electric tool battery 13 detached from the first battery attachment unit 31 may also be detachably attached to a tool main body of an electric tool through sliding with respect to the tool main body. That is, the electric tool B can be used as the power source of the electric tool. Examples of the electric tool include a driver, wrench, drill, reciprocating saw, chain saw, band saw, jig saw, circular saw, grinder, and tacker. Examples of the electric tool battery B include the product "BL1830" in the Makita's General Catalogue issued in April, 2012.

As shown in FIGS. 2 and 6, the opening/closing cover 70 opens and closes the rear space S2 accommodating the battery attachment unit 30 with respect to the exterior. When the opening/closing cover 70 is opened to cause the rear space S2 to communicate with the exterior, the electric tool battery may be attached and detached with respect to the battery attachment unit 30 accommodated in the rear space S2. The lower edge 71 of the opening/closing cover 70 is hinge-connected to the case main body 40 via a hinge pin 79. This hinge pin 79 is retained at the case main body 40. As shown in FIG. 10, this opening/closing cover 70 is formed in a size allowing detachment of the electric tool battery B from the battery attachment unit 30 when it is opened. More specifically, the configuration and size of the opening/closing cover 70 are such that when the opening/closing cover 70 is opened, the upper surface and the rear surface of the electric tool battery B attached to the battery attachment unit 30 are completely exposed. Further, when the opening/closing cover 70 is opened, the opening/closing cover 70 exposes the right and left surfaces of the electric tool battery B so that the right and left surfaces can be grasped.

Figure 4:
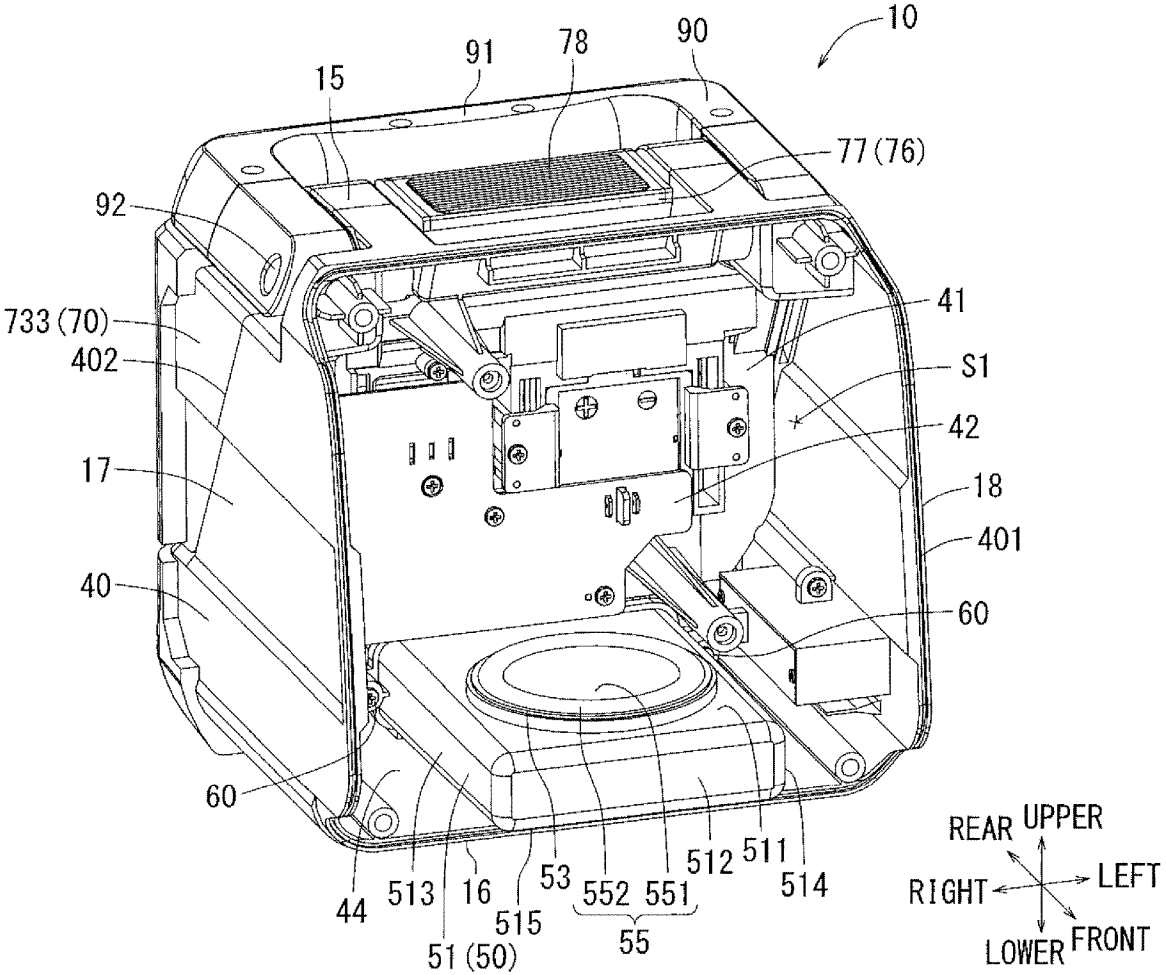
FIG. 4 is a front view of the speaker without a front surface frame.

As shown in FIGS. 1, 2 and 4, the opening/closing cover 70 has a rear surface 731 constituting substantially all of the rear surface 14 of the case 12, an upper surface 732 constituting a part of the upper surface 15, a right surface 733 constituting a part of the right surface 17, and a left surface 734 constituting a part of the left surface 18. The configuration and size of the upper surface 732, the right surface 733, and the left surface 734 are such that when the opening/closing cover 70 is opened the electric tool battery B is exposed so that the electric tool battery B can be grasped. In particular, when the opening/closing cover 70 is opened, the male hook operation portion of the electric tool battery and the side surface for grasping the electric tool battery attached to the battery attachment unit 30 are exposed to the exterior. Thus, the electric tool battery B may be detached from the battery attachment unit 30 through releasing the hook of the electric tool battery B and sliding the electric tool battery B out of the unit.

Figure 8:
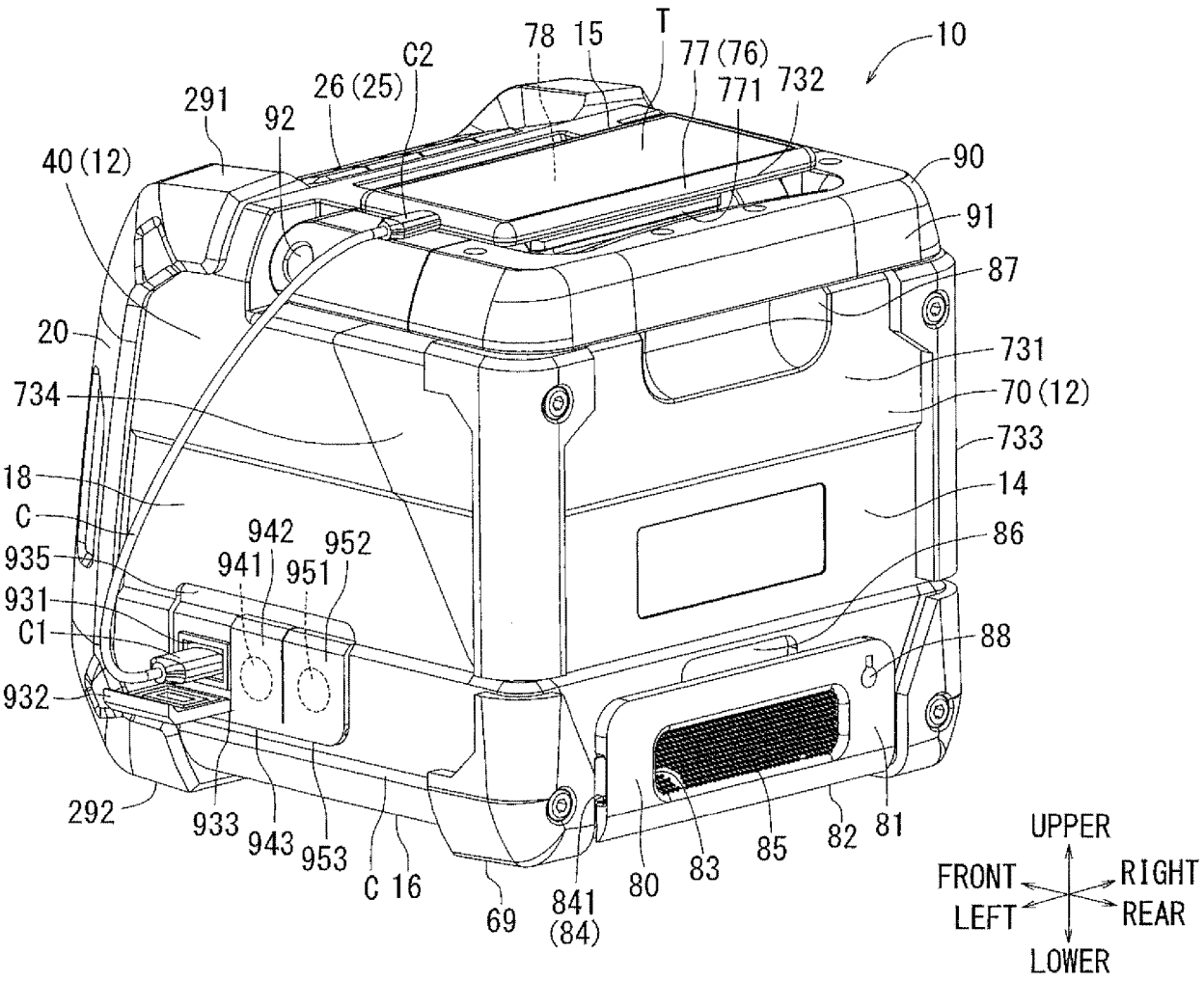
FIG. 8 is a perspective view of the speaker on which a portable electric apparatus is mounted as seeing from back.
Figure 9:
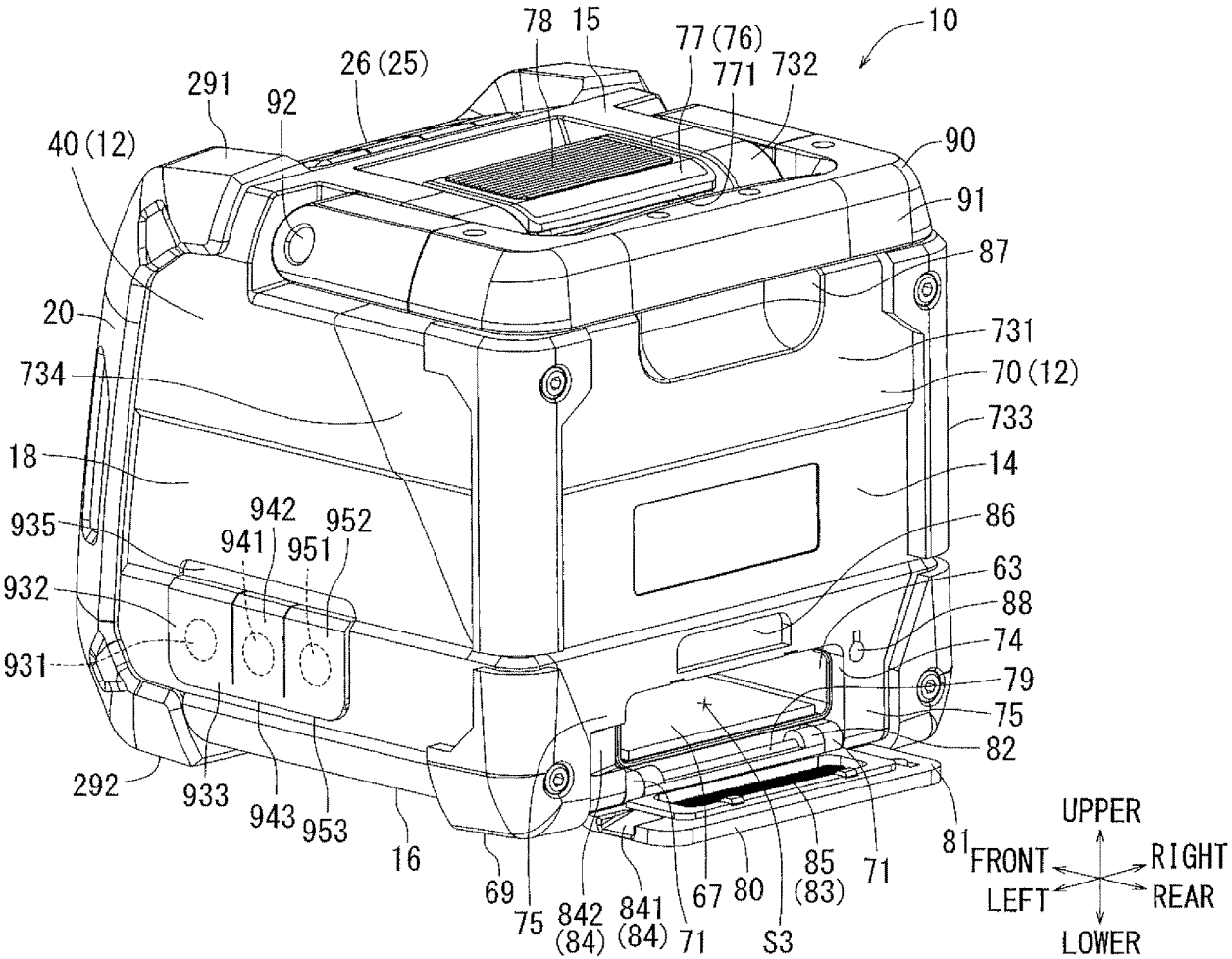
FIG. 9 is a perspective view of the speaker with an opened door as seeing from back.

As shown in FIG. 9, the rear surface 731 of the opening/closing cover 70 is formed with an opening 74 in the lower portion thereof. The opening 74 is provided at the rear of an opening 63 of the resonance case 50 (see FIG. 5) for exposing the opening 63 located at the rear portion of the resonance case 50 to the exterior. Support portions 75 are situated on both the right and left of the opening 74. The support portions 75 are continuous with the right and left surfaces 733 and 734 and extend downwards from the right and left surfaces 733 and 734. The support portions 75 are situated in the lower central region of the rear surface 14 and are situated between the lower right and lower left peripheries of the rear surface 14, where the lower right and lower left peripheries of the rear surface 14 are defined by and integral with the lower regions of the right surface 17 and the left surface 18, respectively. A lower edge 71 is provided at the lower portion of each support portion 75 and protrudes toward the opening 74 from the right and left surfaces 17 and 18. The hinge pin 79 extends between the two lower edges 71, and extends through the lower edges 71. Both ends of the hinge pin 79 are retained in the lower right and lower left regions of the rear surface 14. As shown in FIGS. 2, 5, and 8, a latch mechanism 76 is provided at the front portion of the upper surface 732 of the opening/closing cover 70.

As shown in FIG. 6, the latch mechanism 76 fixes the opening/closing cover 70 to the case main body 40 in a closed position. The latch mechanism 76 has a support protrusion 761, a toggle support portion 763, and a latch main body 77. The support protrusion 761 protrudes upwardly from the upper surface 732 of the opening/closing cover 70. One end of the toggle support portion 763 is connected to the support protrusion 761 via a shaft so as to rotate with respect to the support protrusion 761. The other end of the toggle support portion 763 is connected to the latch main body 77 via a shaft so as to rotate with respect to the latch main body 77. The latch main body 77 has a grip 771 in the vicinity of the shaft connection of the toggle support portion 763, and has a hook 773 on the opposite side of the latch main body 77. The hook 773 is configured to be capable of locking to the main body hook 45 on the upper surface of the case main body 40.

As shown in FIGS. 5 and 6, the toggle support portion 763 rotates with respect to the support protrusion 761 by pulling the grip 771 to displace the latch main body 77. In accordance with the rotation of the toggle support portion 763, the hook 773 of the latch main body 77 is locked or released with respect to the main body hook 45. The latch main body 77 has an upper surface 775. The upper surface 775 is situated so as to expand in the horizontal direction when the hook 773 is locked to the main body hook 45. A fastening rubber 78 is mounted to the upper surface of the upper surface 775. The fastening rubber 78 is formed of an elastic material such as rubber resin. Notches are formed on the upper surface of the fastening rubber 78. The fastening rubber 78 generates a high frictional force (holding force) due to its elastic force and surface notches. Thus, as shown in FIG. 8, the portable electric apparatus T installed on the fastening rubber 78 is held in place in a stable manner without large deviations in movement with respect to the fastening rubber 78.

As shown in FIG. 10, a seal structure is provided between the edge 43 of the case main body 40 and the edge 72 of the opening/closing cover to bring the edges 43 and 72 into close contact with each other when the opening/closing cover 70 is closed. The edge 43 of the case main body 40 is situated at the edge of a rear surface opening 402 of the case main body 40. The seal structure effects sealing between the edge 43 and the edge 72 by utilizing the sealing property, for example, of a gasket. More specifically, as shown in FIG. 5, a groove (recess) 431 is formed along the edge 43 of the case main body 40, and a portion of a rubber gasket 432 is fitted into the groove 431. The rubber gasket 432 is held in close contact with the edge 72 of the opening/closing cover 70 in the closed state.

As shown in FIGS. 5 and 6, the opening/closing cover 70 is rotatably connected to the case main body 40 by a hinge pin 79. The case main body 40 supports the hinge pin 79 near the rear end of the case main body 40 and near the lower end of the case 12. The center of gravity of the closed opening/closing cover 70 is situated above and on the front of the hinge pin 79. Thus, due to the center of the gravity, the weight of the closed opening/closing cover 70 acts directionally so as to cause the opening/closing cover 70 to forwardly rotate, and maintains the opening/closing cover 70 in the closed state. Both right and left portions of the case main body 40 that are close to the hinge pin 79 are covered with an elastomer 69 similar to the elastomer 292 of the lower portion of the front surface frame 20.

As shown in FIGS. 4 and 5, a resonance case 50 is provided below the front space S1 and the rear space S2. The resonance case 50 includes an inner space that is a resonance space S3. The resonance space S3 is defined so as to be separated from the front space S1 and the rear space S2. The resonance case 50 has a first box-shaped member 51 and a second box-shaped member 61 arranged on the front and rear sides. The first box-shaped member 51 and the second box-shaped member 61 configure the resonance space S3. The resonance space S3 includes the inner space of the first box-shaped member 51 and the inner space of the second box-shaped space 61. The first box-shaped member 51 has substantially a box shape to define the resonance space S3 so as to separate the resonance space S3 from the front space S1. More specifically, the first box-shaped member 51 is formed as a bottomed rectangular tube having an upper wall 511, a front wall 512, a right wall 513, a left wall 514, and a lower wall 515.

As shown in FIGS. 5 and 6, the rear portion of the first box-shaped member 51 is open so that the interior thereof may be continuous with the interior of the second box-shaped member 61. The lower wall 515 is in face contact with the inner bottom surface 44 of the case main body 40. The upper wall 511, the front wall 512, the right wall 513, and the left wall 514 function as partitions to separate the resonance space S3 (second inner space) from the front space S1 (first inner space). The first box-shaped member 51 and the second box-shaped member 61 form a second inner wall structure that defines the second inner space. The front space S1 and the resonance space S3 are separated from each other by the first box-shaped member 51 (resonance case 50) and are adjacent to each other.

As shown in FIGS. 5 and 6, the second box-shaped member 61 is a substantially rectangular tube that separates the resonance space S3 from the rear space S2. More specifically, as shown in FIG. 11, the second box-shaped member 61 is formed as a rectangular tube having an upper wall 611, a right wall 613, a left wall 614, and a lower wall 615. The front portion of the second box-shaped member 61 is open so as to be continuous with the interior of the first box-shaped member 51. An opening 63 is formed at the rear portion of the second box-shaped member 61 that allows the interior of the second box-shaped member 61 to communicate with the exterior. The upper wall 611, the right wall 613, and the left wall 614 function as partitions that separates the resonance space S3 (second inner space) from the rear space S2 (third inner space).

As shown in FIG. 4, the first box-shaped member 51 and the second box-shaped member 61 are arranged side by side in the front-rear direction, and are connected together by screws 60. The first box-shaped member 51 and the second box-shaped member 61 are smoothly continuous with each other, and are formed, as a whole, as a bottomed rectangular tube. More specifically, the upper walls 511 and 611 are smoothly continuous with each other. The right walls 513 and 613 are smoothly continuous with each other. The left walls 514 and 614 are smoothly continuous with each other. The lower walls 515 and 615 are also smoothly continuous with each other. As shown in FIG. 5, a double lower wall 65 is situated below the lower wall 615 of the second box-shaped member 61. As shown, the double lower wall 65 is substantially parallel to the lower wall 615. The rear portion of the lower wall 615 and the rear portion of the double lower wall 65 are connected to each other.

As shown in FIG. 4, a circular opening 53 is formed in the upper wall 511 of the first box-shaped member 51. A drone cone 55 is installed in the circular opening 53 to close the circular opening 53. The drone cone 55 constitutes an elastic partition, which is a part of the partition that separates the resonance space S3 (second inner space) from the front space S1 (first inner space). The drone cone 55 is also called as a passive speaker, and oscillates upon receiving the sound output from the speaker main body 22. The drone cone 55 is formed of an elastic material that easily undergoes resonance in correspondence with the sound output. For example, the elastic material consists of a rubber resin. The drone cone 55 has a circular flat plate 551 and a curved portion 552 formed integrally with the circular flat plate 551 so as to extend along the outer periphery of the circular flat plate 551. The curved portion 552 is of a curved configuration easily allowing elastic deformation so that the circular flat plate 551 may easily undergo resonance.

As shown in FIGS. 5 and 6, an opening 63 is provided at the rear end of the resonance case 50. The opening 63 allows the interior of the resonance case 50 to communicate with the exterior. Small articles may be accommodated in the resonance space S3 that is inside of the resonance case 50. Examples of the small articles include a portable electric apparatus T such as a smart phone, a tablet, a portable music player, and a portable game machine. The resonance space S3 is of a size allowing accommodation of a smart phone of a 6-inch display screen. Such a portable electric apparatus T can be put in and out of the resonance space S3 of the resonance case 50 (second box-shaped member 61) via the opening 63. A door 80 is provided on the bottom rear portion of the speaker 10, positioned on the bottom portion of the opening/closing cover 70, for opening and closing the opening 63, when the opening/closing cover 70 is in a closed position. The resonance space S3 is opened to the exterior through opening of the door 80. A buffer mat 67 is mounted on the lower walls 515 and 615 and positioned inside of the resonance space S3. The buffer mat 67 may mitigate the shock impact upon the portable electric tool T.

As shown in FIG. 9, the door 80 has a door body 81 supported by the hinge pin 79 so as to allow opening and closing with respect to the opening/closing cover 70. The lower edge 82 of the door body 81 is rotatably supported by the case main body 40 via the hinge pin 79. The hinge pin 79 supports the opening/closing cover 70 so as to allow opening with respect to the case main body 40. The hinge pin 79 also supports the door body 81 of the door 80 so as to allow opening and closing with respect to the opening/closing cover 70. The hinge pin 79 is supported by the case main body 40 near the lower rear end of the case 12. An opening 83 is formed in the central portion of the door body 81, and extends perpendicularly through the left-to-right plane of the door body 81. The opening has a size and configuration coinciding with those of the opening 63 of the resonance case 50. As shown in FIG. 2, when the opening/closing cover 70 is in the closed position, and the door 80 is in the closed position, the opening 74 (see FIG. 9) and the opening 83 are situated in the rear region corresponding to the opening 63 of the resonance case 50. Thus, the openings 63, 74, and 83 overlap with each other, whereby the resonance space S3 is able to communicate linearly with the exterior via the openings 63, 74, and 83.

As shown in FIGS. 5 and 9, the resonance space S3 is breathable through the opening 63 and the opening 83 (first through-hole portion). A mesh member 85 is attached to the opening 83 of the door body 81. The mesh member 85 is formed as a net-like substance that is appropriately breathable. Although the mesh member 85 allows external air to flow into the resonance space S3, the mesh member 85 prevents a human finger or the like to be inserted into the resonance space S3. A cord lead-out portion 84 through which a cord C is passed, as shown in FIG. 2, is defined between the opening/closing cover 70 and the door 80, enabling the door 80 to sit flush against the opening/closing cover 70 despite the cord's passing through. As shown, the cord lead-out portion 84 is located in the adjacent to the left side of the opening 74. The cord C may be connected to the portable electric apparatus T when, for example, the portable electric apparatus T is to be recharged. As shown in FIG. 1, the cord C has a main body side connection connector C1 at one end. As shown in FIG. 5, the cord C has a portable electric apparatus T side connection connector C2 at the other end. As shown in FIGS. 2 and 9, the connection cord C is drawn out to the exterior from the resonance space S3 via the cord lead-out portion 84. The cord lead-out portion 84 (second through-hole portion) has a first cutout portion 841 provided in the door body 81, and a second cutout portion 842 provided in the opening/closing cover 70. The first cutout portion 841 and the second cutout portion 842 are situated so as to be opposite each other, complementarily forming a composite space when the door body 81 sits against the cover 70 to enable the cord C to pass through.

As shown in FIG. 9, the first cutout portion 841 (second through-hole portion) is formed so as to cut out from the left side of the opening 83 to the left edge of the door body 81. The cutout depth of the first cutout portion 841 increases as it extends toward the left side. The second cutout portion 842 (second through-hole portion) is formed so as to cut out the support portion 75 on the left side of the opening/closing cover 70. The cutout depth of the second cutout portion 842 decreases as it extends toward the left side. The speaker 10 has a lock device that locks the door 80 in the closed state, and a keyhole 88 that operates the lock device. A key is inserted into the keyhole 88 and turned with relation to the keyhole 88 to operate the lock device so that the lock device maintains the door 80 in the closed state or release the locked door 80. The lock device may lock the door 80 in the closed position directly to the case main body 40. Alternatively, the lock device may lock not only the door 80 in the closed position but also the opening/closing cover 70 in the closed position to the case main body 40. As a result, the door 80 may be prevented from being freely opened. A recess 86 is formed in the rear surface 14 and is located above the door 80 and above the opening 63*b*. The recess 86 aids in ease of use for a user of the device, where said user may insert a finger into the recess 86 to grab the upper edge of the door 80. Additionally, a recess 87 is formed in the upper region of the rear surface 14. This recess 86 also aids ease of use for a user of the device, where in manipulation of the handle, the user may insert fingers into the recess 87 to grip and manipulate the handle 90, when the handle 90 is to be grasped.

As shown in FIG. 2, the handle 90 is mounted to the upper surface 15 of the case 12. The handle 90 may be grasped by the hand when the speaker 10 is to be carried about. The handle 90 has a handle main body 91 that is rotatably connected to the upper portion of the case main body 40 by shaft connection members 92. The handle 90 may be accommodated in conformity with the substantially cubic configuration of the case 12 when it is not used. The case 12 is provided with three connector portions 931, 941, and 951. The first connector portion 931 is, for example, a USB (universal serial bus) connector. The cord C may be connected to the first connector portion 931. Electric power of the electric tool battery B attached to the battery attachment unit 30 is supplied to the portable electric apparatus T through the first connector portion 931 and the cord C. As a result, the portable electric apparatus T may be recharged. The second connector portion 941 is an external input terminal constituting, for example, an AUX terminal. The portable electric apparatus T may be connected to the second connector portion 941 through a cord that is connected to the second connector portion 941. As a result, the portable electric apparatus T may transmit sound output data to the main control unit 42 even if it does not have radio communication means. The third connector portion 951 is an external input terminal or an external output terminal constituting, for example, a headphone jack. When a headphone is connected to the third connector portion 951, the user can enjoy the sound output solely by the headphone without relying on the speaker output.

As shown in FIG. 1, the first through third connector portions 931, 941, and 951 are arranged side by side in the front-rear direction on the left surface 18 of the case 12. The first through third connector portions 931, 941, and 951 are respectively provided with cover portions 932, 942, and 952. When the first through third connector portions 931, 941, and 951 are not used, the cover portions 932, 942, and 952 cover the first through third connector portions 931, 941, and 951 to protect the first through third connector portions 931, 941, and 951. The cover portions 932, 942, and 952 are integrally connected to the case main body 40 via hinge portions 933, 943, and 953 that are set at the lower edge of the cover portions 932, 942, and 952. The hinge portions 933, 943, and 953 are formed of thin-walled resin so as to function as hinges. A recess 935 is formed in the left surface 18. This recess 935 aids in ease of use of the hinges, where a finger of a user may be inserted into the recess 935 to hook the finger on the upper edges of the cover portions 932, 942, and 952, enabling ease in opening the cover portions 932, 942, and 952.

The speaker 10 provides several advantages compared to existing speakers. For example, as shown in FIG. 5, the case 12 has the resonance space S3 that is subdivided from the front space S1. The front space S1 accommodates the speaker main body 22. The dedicated compartment comprising resonance space S3 serves as a resonator causing resonance of the sound output of the speaker main body 22. The resonance space S3 can cause the sound output from the speaker main body 22 in the front space S1 to undergo Helmholtz resonance in the resonance space S3, and can amplify the lower register and longer wavelength portion of the output sound to enhance the sound produced. The resonance space S3 communicates with the exterior for resonance, with the mode of communication of S3 with the exterior as described above. Thus, even though there is a mesh protection, etc., there remains a possibility of intrusion of dust and water from the exterior into the resonance space S3. Since the resonance space S3 and the front space S1 are formed separately, direct intrusion of even residual dust and water into the front space S1 may be suppressed.

As shown in FIG. 5, the resonance space S3 may communicate with the exterior, and dust and water may intrude from the exterior. The juxtaposition of S1, S2, and S3 is shown, where the front space S1 is adjacent to the resonance space S3 on the upper side of the resonance space S3. Thus, the dust and water in the resonance space S3 may be prevented from intruding into the front space S1 because the dust and water in the resonance space S3 are subjected to the gravitational effect. Further, the front space S1 and the resonance space S3 are formed so as to be separate from each other by the case 12 and the resonance case 50. The front space S1 accommodating the speaker main body 22 may be formed in a hermetic configuration, with the presence of upper wall 511 of resonance case 50 providing a barrier from S3. The configuration described above may enhance the dustproof/waterproof effect of the front space S1. The resonance space S3 is adjacent to the front space S1 while partitioned therefrom, such that while providing a dust/waterproof effect, the sound output in the front space S1 may be resonated in the resonance space S3 by Helmholtz resonance.

As shown in FIG. 5, the drone cone 55 is formed so as to be capable of oscillating upon receiving the sound output of the speaker main body 22. The oscillating drone cone 55 may easily resonate the sound output in the front space S1 in a manner of Helmholtz resonance. As a result, the sound effect in amplifying the lower register of the output sound may be efficiently enhanced. That is, the resonance space S3 can provide an effect similar to that of a bass reflex mechanism. For example, a sound of a frequency of 100 Hz by 3 dB may be amplified. Furthermore, a sound of a frequency in an inaudible sound range lower than a sound of audio-frequency may be attenuated. Thus, the speaker 10 can output sound in a high tone quality while enhancing the dustproof/waterproof effect.

As shown in FIG. 6, a rubber gasket 432 is provided between the edge 43 of the case main body 40 and the edge 72 of the opening/closing cover 70. The rubber gasket 432 may bring the edges 43 and 72 into close contact with each other when the opening/closing cover 70 is closed. The rubber gasket 432 hermetically closes the front space S1 and the rear space S2 in the case 12 when the opening/closing cover 70 is closed. Thus, through the gasket, the dustproof/waterproof effect of the front space S1 and the rear space S2 in the case 12 may further be enhanced. The rear space S2 contains the battery attachment unit 30 to and from which the electric tool battery B is attached and detached. Thus, the battery attachment unit 30 and the electric tool battery B are protected from dust and water. This may suppress failure of the speaker 10 or of the electric tool battery B.

The resonance space S3 is configured to accommodate the portable electric tool T, for example a 6-inch smart phone. By providing such a storage facility, in addition to a cord lead-out provision, including specialized structure as described above, this may further enhance convenience for the user of the speaker 10. The door 80 may enhance the dustproof/waterproof property of the interior of the resonance space S3. The door 80 is formed with an opening 83 allowing ventilation between the resonance space S3 and the exterior, with a fitted mesh as described above. Thus, due to this unique structural configuration, the speaker 10 like a bass reflex mechanism, can easily effect Helmholtz resonance in the resonance space S3.

As shown in FIGS. 2 and 9 and previously described, the speaker 10 has a lock device that locks the door 80 in the closed position, and a keyhole 88 for operating the lock device. This lock device provides a security-enhancing feature for the speaker 10, wherein the door 80 that is locked in the closed position may prevent the portable electric tool T within the resonance space S3 from being stolen. As described above, the door 80 is provided with a cord lead-out portion 84 making it possible to lead a cord C to the exterior from within the resonance space S3. Thus, the cord C connected to the first connector portion 931 may be led into the interior of the resonance space S3. As a result, the portable electric tool T stored in the resonance space S3 may be recharged. As shown in FIG. 1, the case 12 is provided with an operation panel portion 26 allowing operation of the portable electric apparatus T via radio communication. Thus, the portable electric apparatus T stored in the resonance space S3 may also be operated by use of the operation panel portion 26.

The case 12 may also have a different configuration from the substantially cubic configuration previously described. As described above, the case 12 has three divisional components those are the case main body 40, the front surface frame 20, and the opening/closing cover 70. Alternatively, the case 12 may have another appropriate divisional construction. The resonance space S3 may be provided above and adjacent to the front space S1 as described above. Alternatively, the resonance space S3 may be provided at a vertically intermediate position inside the front space S1. In this structure, the door 80 may be situated above the ground surface or the elastomers 292 and 69 contacting the ground surface. This configuration may enhance the dustproof/waterproof property of the interior of the resonance space S3, because the resonance space S3 is apart from the dust on the ground surface.

As described above, the resonance case 50 may be provided with the drone cone 55. Alternatively, the resonance case 50 may not be provided with the drone cone 55. For example, the drone cone 55 may be abolished, and the first inner space (front space S1) and the second inner space (resonance space S3) may be situated adjacent to each other, with the first inner space and the second inner space being arranged so as to communicate with each other only partially or separated from each other. In this construction also, the first inner space and the second inner space are set to be different spaces. Thus, even in the case where the second inner space communicates with the exterior for resonance and where dust and water may intrude from the outside, the dust and water may not enter the first inner space immediately.

In the second inner space, a labyrinth structure may be provided as appropriate. For example, the resonance space S3 has an opening at the rear end where the door 80 exists. In front of and above the resonance space S3, communication is established between the resonance space S3 and the front space S1. That is, the passage leading to the first inner space from the exterior via the second inner space is not a simple straight passage but exhibits a labyrinth structure. As a result, dust and water do not easily enter the first inner space from the second inner space. Alternatively, the second inner space (resonance space) which is of an appropriate configuration and which has no drone cone 55 may be provided between the door 80 and the first inner space.

Further, the second inner space may have a shape that may suppress dust and water from flowing into the first inner space from the door 80.

As described above, the speaker 10 has the door 80 for opening and closing the resonance space S3 with respect to the exterior. Thus, the door 80 suppresses intrusion of dust and water into the resonance space S3.

The resonance case 50 may adopt an appropriate configuration. For example, in the above-described embodiment, the second box-shaped member 61 may separate the first inner space (space S1, S2) and the second inner space (resonance space S3) from each other. The drone cone 55 also acts so as to separate the first inner space and the second inner space from each other. Instead of this construction, another construction or configuration or material that may separate the first inner space and the second inner space from each other may be adopted.

The above-described embodiment has the space S1 accommodating the sound output unit, and the space S2 accommodating the battery attachment unit 30, with the space S1 and the space S2 communicating with each other. Alternatively an appropriate partition separating the space S1 and the space S2 from each other may be provided between the space S1 and the space S2. The space S1 and the space S2 may communicate with some other space.

In the above-described embodiment, electric power is supplied from the electric tool battery. Alternatively or additionally, electric power may be supplied from the home AC power source.

The above-described embodiment is specified as a sound output device in which attention is focused on sound output. Alternatively, the embodiment may consist of an electrical product to which the above-described battery type sound output device is applied and within which it may be incorporated. For example, it may be a radio set or a telephone including a battery type sound output device such as the speaker 10. Alternatively, it may be a radio set including a battery type sound output device and having a transmission/reception unit configured to transmit/receive sound (sound data) through radio communication. Alternatively, it may be a telephone including a battery type sound output device and having a transmission/reception unit configured to transmit/receive sound (sound data) through radio communication.

The various examples described above in detail with reference to the attached drawings are intended to be representative of the invention and thus not limiting. The detailed description is intended to teach a person of skill in the art to make, use and/or practice various aspects of the present teachings and thus is not intended to limit the scope of the invention. Furthermore, each of the additional features and teachings disclosed above may be applied and/or used separately or with other features and teachings to provide improved battery type sound output devices, and/or methods of making and using the same.

What is claimed is:

1. A sound output device comprising:

a sound output unit configured to output sound to an exterior, wherein the sound output unit comprises a magnet and voice coil;

a battery attachment unit to which an electric tool battery is attached, wherein the battery attachment unit comprises an electrical contact terminal and a female hook formed by recesses for attaching the battery; and a case configured to support the sound output unit and the battery attachment unit, wherein:

the case includes a first inner wall structure configured to define a first inner space accommodating the sound output unit, and a second inner wall structure configured to define a second inner space different from the first inner space, and the second inner wall structure is configured to resonate the sound output of the sound output unit, the first inner space and the second inner space are divided from each other by a partition, and the partition has an elastic partition formed so as to be capable of vibration upon receiving the sound output of the sound output unit.

2. The sound output device of claim 1, wherein the first inner wall structure and the second inner wall structure are provided in the case such that the first inner space is above and adjacent to the second inner space.

3. The sound output device of claim 1, wherein the second inner space is configured to be capable of containing a gadget.

4. The sound output device of claim 3, wherein the second inner wall structure has a door configured to open and close the second inner space with respect to the exterior.

5. The sound output device of claim 4, wherein the door has an opening configured to communicate between the second inner space and the exterior.

6. The sound output device of claim 4, further comprising a locking device configured to releasably lock the door.

7. The sound output device of claim 6, wherein the case includes a third inner wall structure configured to define a third inner space that contains the battery attachment unit, the third inner wall structure has an opening configured to cause the third inner space to communicate with the exterior, and an opening/closing cover configured to close the opening so as to allow opening and closing, the locking device may be configured to releasably lock both the door and the opening/closing cover together.

8. The sound output device of claim 4, wherein the case is provided with a cord lead-out portion configured to allow a cord to be led to the exterior from within the second inner space.

9. The sound output device of claim 1, wherein the case is provided with an operation input unit configured to operate a gadget via radio communication, wherein the operation input unit comprises an array of buttons.

10. The sound output device of claim 9, wherein the operation input unit further comprises a circuit board with an onboard radio communication module.

11. The sound output device of claim 1, further comprising the electric tool battery that is capable of supplying electric power to the sound output unit.

12. The sound output device of claim 1, wherein the sound output unit further comprises a speaker main body, a tweeter speaker, and a sub control portion, wherein the sub control portion comprises a printed circuit board configured to control the output of the speaker main body and of the tweeter speaker.

13. The sound output device of claim 1, where the battery attachment unit further comprises a slide-guide portion comprising of a flange to which fit, engage, and guide the sliding of the battery into and out of the device.

14. The sound output device of claim 1, further comprising a second battery attachment unit wherein the second battery attachment unit comprises an electrical contact terminal and a female hook formed by recesses for attaching the battery.

15. The sound output device of claim 14, wherein the battery attachment unit and the second battery attachment unit are structurally positioned such that it is impossible to insert batteries into both the battery attachment unit and the second battery attachment unit, respectively, at the same time.

16. A sound output device comprising:

a sound output unit configured to output sound to an exterior, wherein the sound output unit comprises a magnet and voice coil;

a battery attachment unit to which an electric tool battery is attached, wherein the battery attachment unit comprises an electrical contact terminal and a female hook formed by recesses for attaching the battery; and a case configured to support the sound output unit and the battery attachment unit; wherein:

the case includes a first inner wall structure configured to define a first inner space accommodating the sound output unit, a second inner wall structure configured to define a second inner space different from the first inner space, and a third inner wall structure configured to define a third inner space that contains the battery attachment unit, the second inner wall structure is configured to resonate the sound output of the sound output unit, the third inner wall structure has an opening configured to cause the third inner space to communicate with the exterior, and an opening/closing cover configured to close the opening so as to allow opening and closing, and a seal structure is provided between an edge of the opening and an edge of the opening/closing cover, and is configured to bring the edges into close contact with each other when the opening/closing cover is closed.

17. The sound output device of claim 16, wherein the second inner space is configured to be capable of containing a gadget.

18. The sound output device of claim 17, wherein the second inner wall structure has a door configured to open and close the second inner space with respect to the exterior.

19. A battery type sound output device comprising:

a sound output unit configured to output sound to an exterior;

a battery attachment unit to which an electric tool battery is attached, and a case configured to support the sound output unit and the battery attachment unit, wherein:

the case includes a first inner wall structure configured to define a first inner space accommodating the sound output unit, a second inner wall structure configured to define a second inner space different from the first inner space, and a third inner wall structure configured to define a third inner space that contains the battery attachment unit, the second inner wall structure is configured to resonate the sound output of the sound output unit, the third inner wall structure has an opening configured to cause the third inner space to communicate with the exterior, and an opening/closing cover configured to close the opening so as to allow opening and closing, and a seal structure is provided between an edge of the opening and an edge of the opening/closing cover and is configured to bring the edges into close contact with each other when the opening/closing cover is closed.

20. The battery type sound output device of claim 19, further comprising a second battery attachment unit, wherein both the battery attachment unit and the second battery attachment unit comprise electrical contact terminals, female hooks formed by recesses for attaching the battery, and slide-guide portions comprising of flanges to which fit, engage, and guide the sliding of the battery into and out of the device, where it is impossible to insert batteries into both the battery attachment unit and the second battery attachment unit, respectively, at the same time.

21. A battery type sound output device comprising:

a sound output unit configured to output sound to an exterior;

a battery attachment unit to which an electric tool battery is attached;

a case (1) configured to support the sound output unit and the battery attachment unit and (2) including a first inner wall structure configured to define a first inner space accommodating the sound output unit and a second inner wall structure configured to define a second inner space different from the first inner space; and an elastic partition between the first inner space and the second inner space; wherein:

the second inner wall structure is configured to resonate the sound output of the sound output unit, and the second inner wall structure is provided below the first inner wall structure and the battery attachment unit.

22. The battery type sound output device of claim 21, wherein the second inner wall structure blocks dirt and water from passing from the second inner space to the first inner space.

23. A sound output device comprising:

a sound output unit configured to output sound to an exterior, wherein the sound output unit comprises a magnet and voice coil;

a battery attachment unit to which an electric tool battery is attached, wherein the battery attachment unit comprises an electrical contact terminal and a female hook formed by recesses for attaching the battery; and a case configured to support the sound output unit and the battery attachment unit, wherein:

the case includes a first inner wall structure configured to define a first inner space accommodating the sound output unit, and a second inner wall structure configured to define a second inner space different from the first inner space, and the second inner wall structure is configured to resonate the sound output of the sound output unit;

the second inner wall structure has a door configured to open and close the second inner space with respect to the exterior; and the door has an opening configured to communicate between the second inner space and the exterior.

24. A sound output device comprising:

a sound output unit configured to output sound to an exterior, wherein the sound output unit comprises a magnet and voice coil;

a battery attachment unit to which an electric tool battery is attached, wherein the battery attachment unit comprises an electrical contact terminal and a female hook formed by recesses for attaching the battery; and a case configured to support the sound output unit and the battery attachment unit, wherein:

the case includes a first inner wall structure configured to define a first inner space accommodating the sound output unit, a second inner wall structure configured to define a second inner space different from the first inner space, and a third inner wall structure configured to define a third inner space that contains the battery attachment unit;

the second inner wall structure is configured to resonate the sound output of the sound output unit and has a door configured to open and close the second inner space with respect to the exterior;

the third inner wall structure has an opening configured to cause the third inner space to communicate with the exterior, and an opening/closing cover configured to close the opening so as to allow opening and closing; and a locking device is configured to releasably lock both the door and the opening/closing cover together.

* * * * *